US006364507B1

(12) United States Patent
Yang

(10) Patent No.: US 6,364,507 B1
(45) Date of Patent: Apr. 2, 2002

(54) WATERPROOF LED DISPLAY

(75) Inventor: Chung-Chin Yang, Taipei (TW)

(73) Assignee: Formosa Industrial Computing Inc., Taipei (TW)

( * ) Notice: Subject to any disclaimer, the term of this patent is extended or adjusted under 35 U.S.C. 154(b) by 0 days.

(21) Appl. No.: 09/562,416

(22) Filed: May 1, 2000

(51) Int. Cl.[7] ..... F21V 1/00

(52) U.S. Cl. ..... 362/248; 362/240; 362/267; 362/800; 362/812; 40/579

(58) Field of Search ..... 362/812, 545, 362/800, 240, 246, 248, 267; 40/578, 579

(56) References Cited

U.S. PATENT DOCUMENTS 5,632,551 A * 5/1997 Roney et al. ..... 362/267
5,715,619 A * 2/1998 Polisois et al. ..... 362/248
6,283,613 B1 * 9/2001 Schaffer ..... 362/245

* cited by examiner

*Primary Examiner*—Stephen Husar
(74) *Attorney, Agent, or Firm*—Thomas, Kayden, Horstemeyer & Risley LLP

(57) ABSTRACT

A waterproof LED display has a housing. A circuit board with a plurality of LED groups is mounted within the housing. A transparent sheet which has a smooth inner surface opposite to the circuit board and a coarse outer surface to prevent reflection of the sunshine, is provided outside the circuit board. A panel with a plurality of apertures to respectively correspond to the groups of LEDs is mounted outside the transparent sheet. Waterproof silica gel is spread over joints between the panel and the housing.

4 Claims, 4 Drawing Sheets

WATERPROOF LED DISPLAY

BACKGROUND OF THE INVENTION

1. Field of the Invention

The present invention is related to an LED display, and more particularly to a waterproof LED display which has watertight construction designed at a front portion thereof.

2. Description of Related Art

In advertising, a signboard made of an LED display generally standing at a conspicuous location, such as a bustling road, is widely used. The LED display comprises a plurality of LEDs controlled by special hardware and software to perform moving images on a screen thereof to attract the attention of passersby.

A conventional LED display, as shown in FIGS. 3 and 4, has a housing (20) and a circuit board (21) mounted on a front portion of the housing (20). The circuit board (21) has a plurality of LED groups (22) formed thereon. A layer of waterproof gel (23) is spread on the circuit board (21) and these LEDs (22). However, it is a very difficult process to control spreading the waterproof gel (23) on the circuit board (21) and these LEDs (22), and if not done properly, water or water vapor can easily penetrate the LED display.

Furthermore, by generally placing the LED display in an outdoor position in the sunshine, wind and rain, the gel (23) easily ages whereby water and water vapor can penetrate the circuit board (21), then the LED display will fail quickly. Moreover, when a user wants to replace a failed LED (22), the gel (23) therearound must be stripped off, and after replacement of the LED (22), new gel (23) is re-spread on the new LED (22) and therearound. However, it is difficult to integrate the new gel (23) and the old gel (23), and a gap may occur whereby water and water vapor can penetrate the circuit board (21).

Therefore, it is an objective of the invention to provide a waterproof LED display to mitigate and/or obviate the aforementioned problems.

SUMMARY OF THE INVENTION

The main objective of the present invention is to provide an LED display which has an effective waterproof function.

Another objective of the present invention is to provide an LED display which is easy to be serviced.

Other objects, advantages and novel features of the invention will become more apparent from the following detailed description when taken in conjunction with the accompanying drawings.

DETAILED DESCRIPTION OF THE PREFERRED EMBODIMENT

Figure 1:
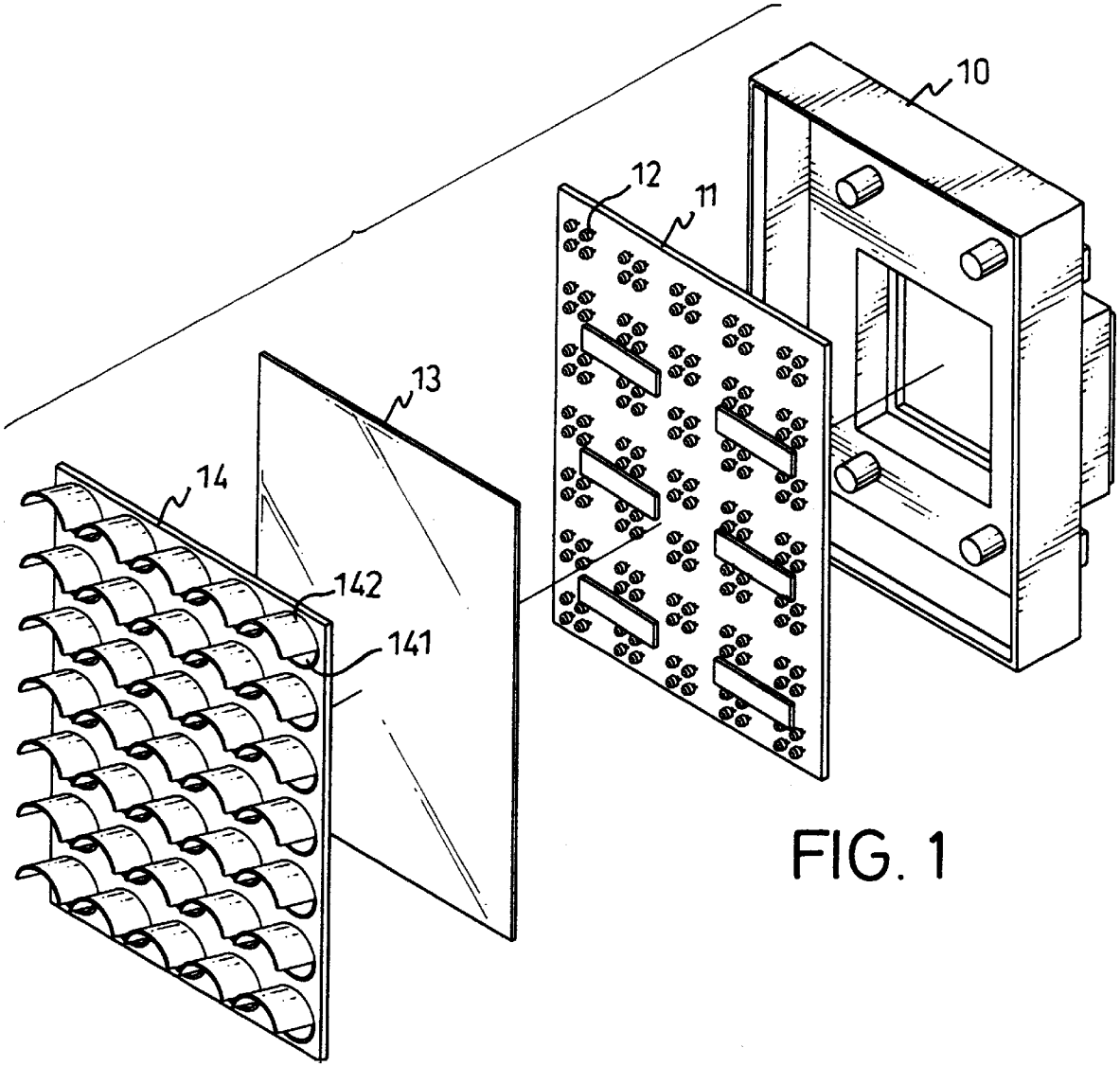
FIG. 1 is an exploded perspective view of a waterproof LED display in accordance with the invention.
Figure 2:
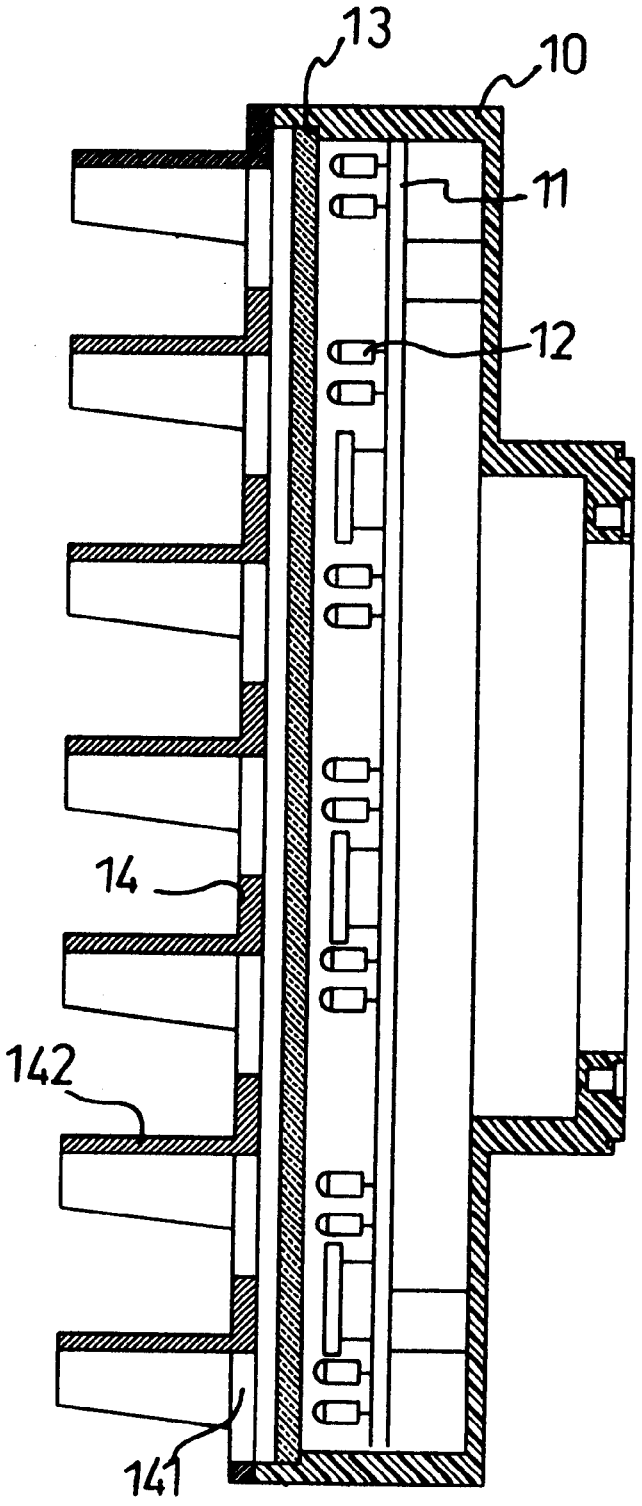
FIG. 2 is a sectional view of the waterproof LED display of FIG. 1.
Figure 3:
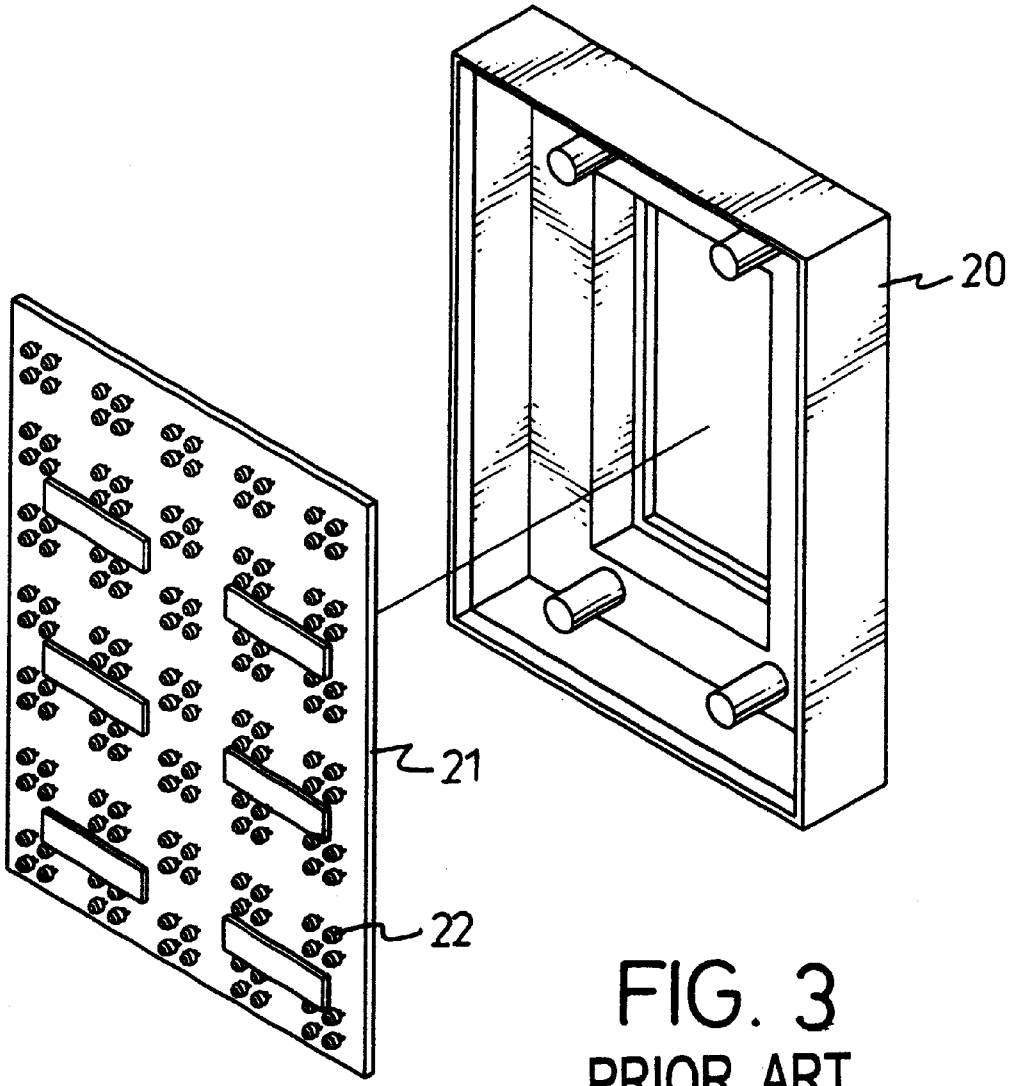
FIG. 3 PRIOR ART
FIG. 3 is an exploded perspective view of a conventional waterproof LED display.
Figure 4:
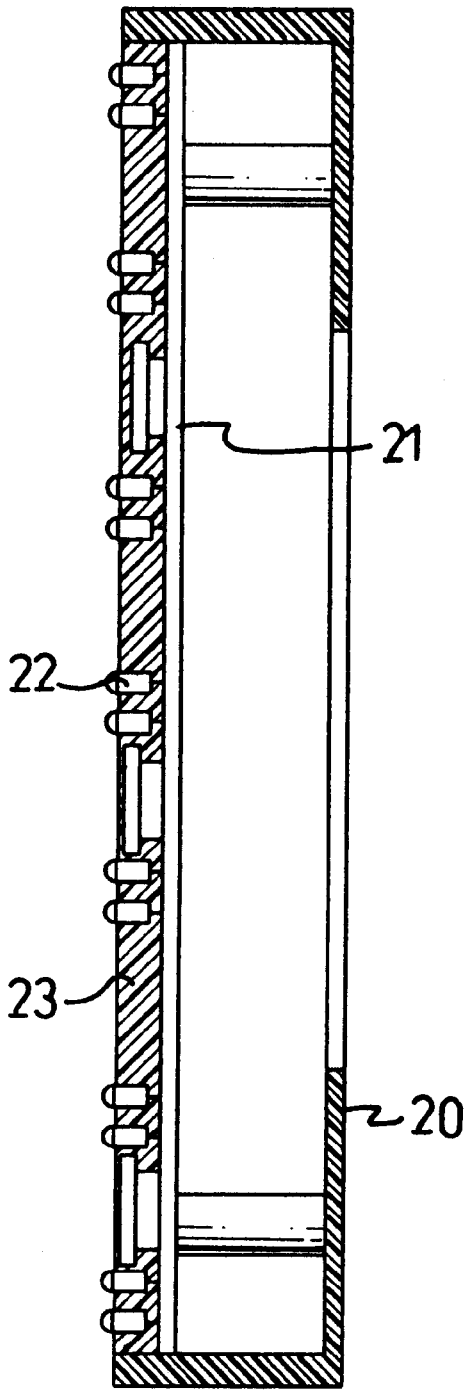
FIG. 4 PRIOR ART
FIG. 4 is a sectional view of the conventional waterproof LED of FIG. 3.

Referring to FIGS. 1 and 2, an LED display in accordance with the present invention comprises a housing (10). A circuit board (11) is provided within the housing (10) and has a plurality of LED groups (12) formed thereon. The circuit board (11) includes electronic elements (not shown or numbered) electrically connected to the LEDs (12). A transparent sheet (13) made of PVC material is mounted in the housing (10) and on a front face of the circuit board (11). The sheet (13) has a smooth inner surface opposite to the circuit board (11) and a coarse outer surface to prevent reflection of sunshine.

A panel (14) fitted to a front of the housing (10) is provided outside the transparent sheet (13). The panel (14) has a plurality of apertures (141) respectively corresponding the groups of LEDs (12). An eave (142) is formed above each of the apertures (141) for further protection from the external light. Finally, waterproof silica gel is spread over joints between the housing (10) and the panel (14) to seal the LED display.

When the LEDs or the circuit board need to be serviced, first the silica gel is removed, then the panel (14), the transparent sheet (13) are removed for replacement of the failed LED (12) or repair of the circuit board (11).

From the above description, it is noted that the invention has the following advantages:

1. Because the LEDs (12) are hidden inside the housing (10) and not exposed, and there is silica gel spread between the housing (10) and the panel (14), it is difficult for water or water vapor to penetrate the housing. Thus, the LED display has an effective waterproof function.

2. Because the silica gel is not directly spread on the LEDs (12), it is easy to remove the silica gel for service of the LED display.

3. By use of the transparent sheet (13) with a coarse outer surface to reduce the reflection of the sunshine, and by use of the eaves (142) to screen the external light, the images performed on the screen of the LED display have a brightness superior to the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof LED display comprising:

a house (10) defined with an opening;

a circuit board (11) securely received in said housing (10) and having a plurality of LEDs (12) formed thereon;

a transparent sheet (13) securely received in said housing (1) and separated from said circuit board (11) and provided with a first side and a second side, said first side covering an illuminating face of said circuit board (11);

a panel (14) sealing said opening of said housing (10) to enclose said circuit board (11) and said transparent sheet (13) inside said housing (10), wherein the panel (14) is separated from said transparent sheet (13) and has a plurality of apertures (141) to correspond said LEDs (12); and a waterproof silica gel spread over joints between said housing (10) and said panel (14), whereby said circuit board (11) and said LEDs are sealed from external water.

2. The waterproof LED display as claimed in claim 1, wherein said transparent sheet (13) is made of PVC material.

3. The waterproof LED display as claimed in claim 1, wherein said first side of said transparent sheet (13) has a smooth surface and the second side has a coarse surface.

4. The waterproof LED display as claimed in claim 1, wherein said panel (14) further comprises a plurality of eaves (142), each of said apertures (141) having formed thereabove one of the eaves (142).

* * * * *